United States Patent [19]

Hodgson et al.

[11] 4,396,217

[45] Aug. 2, 1983

[54] CLAMP HAND PROTECTOR

[76] Inventors: R. W. Hodgson, 1680 No. Vine St., #204, Hollywood, Calif. 90028; Steve A. Rands, 3315 Villa Knolls Dr., Pasadena, Calif. 91107

[21] Appl. No.: 258,469

[22] Filed: Apr. 28, 1981

[51] Int. Cl.[3] ..... B25B 29/00

[52] U.S. Cl. ..... 294/131

[58] Field of Search ..... 294/131, 132, 133, 134, 294/135, 136; 24/262; 403/DIG. 9

[56] References Cited

U.S. PATENT DOCUMENTS 799,380 9/1905 Hoke et al. ..... 294/135

2,822,211 2/1958 Miller ..... 294/131

*Primary Examiner*—James B. Marbert

[57] ABSTRACT

A clamp hand protector for use on a pivoting type clamp having an operating handle member pivotally connected to a linkage element of the clamp and defining therebetween an arcuately-variable-angle junction region, wherein an edge-of-hand protective shield is provided with mounting means for positioning the shield between an inner end of the operating handle member and the arcuately-variable-angle junction region so as to prevent injury to an operator's hand when the clamp is moved between clamped and unclamped relationship or vice versa.

6 Claims, 11 Drawing Figures

CLAMP HAND PROTECTOR

BACKGROUND OF THE INVENTION

The field of the invention is generally that of clamps used for clamping together two or more auxiliary and non-included structural members or the like and normally movable between a closed or clamping position and an open or unclamped position in response to manual operation of an operating handle member. A particularly pertinent prior art type of clamp is a pivoting clamp of a type having several different pivotally-interconnected linkage elements arranged, in accordance with well-known mechanical principles, to move between clamped and unclamped positions and vice versa in response to forcible manual movement of an operating handle member. In one especially pertinent form of prior art clamp of the type just referred to, the operating handle member is arranged in what might be termed an over-center pivoting arrangement relative to the multiple pivotal interconnection points of the multiple linkage elements of the clamp so it will, in effect, be locked when in the clamped position and will be incapable of being accidentally or inadvertently jarred loose or otherwise caused to become unclamped by any forces acting thereon except the proper force applied to the operating handle member in a clamp-opening direction. The particular type of prior art clamp referred to above is widely used, but has a major disadvantage, in that adjacent to the pivotal interconnection of the handle member relative to an outermose one of the linkage elements of the clamps is what might be termed an arcuately-variable-angle junction region which lies immediately adjacent to the inner or lower end of the operating handle member and thus, is quite likely to be at least partially filled or occupied by a part of the little finger edge of a person's hand when the operating handle member is grasped for the purpose of forcibly moving it in a clamp-opening direction. If this occurs, it will be found that the arcuately-variable-angle junction region rapidly closes on the edge of the person's hand, and may severely pinch same, or even cause a severe skin abrasion or flesh wound. This is difficult to avoid, because a considerable amount of manual force is normally applied to the operating handle member to open a locked clamp from the freely clamped relationship, and thus, once it starts to open, it opens rapidly, and the edge of the operating hand is pinched and damaged before the operator knows it.

It is obvious that any modification of such a clamp by the provision of, or cooperation therewith of, any edge-of-hand protective structure would be highly-desirable because it would not, in any way interfere with operation of the clamp, but would completely prevent the possibility of injuring the operator's hand in the manner referred to above, and it is precisely such a highly-desirable and advantageous type of structure that is provided by, and in, the present invention, and which further has advantages virtually completely overcoming the hereinbefore-mentioned prior art problems, disadvantages, and limitations, and all of which advantages flow from, and occur by reason of the specific features of the invention pointed out hereinafter.

SUMMARY

Generally speaking, the novel clamp hand protector of the present invention is intended for use on a pivotally-interconnected-multiple-linkage-elements clamp of what might be termed a toggle-type and which, in one preferred form, comprises three linkage elements pivotally-interconnected for providing the desired arcuate clamping movement of a clamp, or abutment member of a clamp, with respect to one or more auxiliary structural members which are intended to be clamped by the clamp. In such a multiple-linkage-elements clamp of a type wherein a first clamp linkage element is provided with an outwardly extending operating handle member (usually of spatulate cross-sectional configuration) having a second linkage element pivotally connected thereto adjacent to a junction between a lower or inner end of the operating handle member and an upper or outer end of the first clamp linkage element, the present invention provides for the inclusion of a novel edge-of-hand protective shield provided with mounting means cooperable with the composite effectively joined first clamp linkage element and the operating handle member couple thereto adjacent to an intermediate junction or coupling region therebetween at a location effectively separating, shielding, and isolating the operating handle member from a second linkage element pivotally connected to the first linkage element adjacent to the inner end of the handle member for effectively preventing movement of an operating human hand during the grasping of the handle member by the human hand into an arcuately-variable-angle junction region between the first and second pivotally interconnected linkage elements, whereby to prevent the little finger edge of a human hand from being inadvertently or accidentally pinched or otherwise injured in said arcuately-variable-angle junction region during the forced manual operation of the operating handle member for the purpose of moving the clamp from one position to another position (usually from locked clamped position into unlocked unclamped position.)

In one preferred form, the mounting means for mounting said protective shield comprises aperture means for mounting cooperation with the handle member such as by being adapted to be slidably moved thereon to at the proper position adjacent to the above-mentioned intermediate junction or coupling region. In a further and more specific preferred form, the mounting means of the protective shield comprises slotted aperture means for cooperation with the spatulate cross-sectionally shaped configuration of the handle member, whereby to be slidably mountable thereon and to be adapted to be moved into stopping abutment with an upper or outer end of the first linkage element, which is provided by a bifurcated yoke for pivotal connection thereof to a corresponding end of the second interconnecting linkage element.

In an even more detailed preferred version of the form of the invention mentioned immediately above, the protective shield is adapted to be retained in mounted position on the handle member in said junction or coupling region by reason of being retainedly cooperable with a transversely enlarged slipover handle member cover adapted to be mounted on the handle member after the mounting of the protective shield therebelow.

In one preferred form of the invention, the protective shield is made of thin sheet material flat or curvedly shaped for convenient covering isolation of the arcuately-variable-angle junction or coupling region between the first and second pivotally interconnected linkage elements and for receiving, retaining, and stopping cooperation with the little finger edge of a hand during the manual grasping of the handle member by such a hand for forcibly operating the clamp.

OBJECTS OF THE INVENTION

With the above points in mind, it is an object of the present invention to provide a novel clamp hand protector for use with a clamp having at least two (and usually more) relatively arcuately-movable linkage elements and an operating handle member adapted to be grasped for forcibly moving the clamp between closed or clamped and open or unclamped relationship and vice versa and wherein the clamp hand protector prevents any part of a person's clamp-operating hand from being accidentally or inadvertently caught and pinched between any such relatively arcuately-movable elements or portions of the clamp.

It is a further object of the invention to provide a novel clamp hand protector of the type referred to herein which comprises an edge-of-hand protective shield which can be provided as original equipment on the clamp by a very simple and inexpensive mounting procedure, or which can be easily, simply and inexpensively mounted on a pre-existing clamp, with the shield being of extremely simple, inexpensive construction.

It is a further object of the present invention to provide a novel clamp mounted hand protector of the character referred to herein, generically and/or specifically, and which may include any or all of the features referred to herein, either individually or in combination, and which is of extremely easy-to-manufacture, easy-to-package, easy-to-ship, and easy-to-use construction and which is capable of being manufactured in a variety of sizes, shapes, styles, materials, qualities and/or price ranges —all at a relatively low cost, both as to the initial capital cost (including production set-up cost, tooling cost and the like) and as to the subsequent per-unit manufacturing cost, whereby to be conductive to widespread production, distribution, sale and use of the novel hand protector of the present invention for the purposes outlined herein, or for any other substantially functionally equivalent purposes.

Further objects are implicit in the detailed description which follows herinafter (which is to be considered as exemplary of, but not specifically limiting, the present invention), and said objects will be apparent to persons skilled in the art after a careful study of the detailed description which follows.

For the purpose of clarifying the nature of the present invention, several exemplary embodiments of the invention are illustrated in the hereinbelow-described figures of the accompanying drawings and are described in detail hereinafter.

BRIEF DESCRIPTION OF DRAWING FIGURES

FIG. 1 is a fragmentary, pictorial, three-dimensional, oblique view of a perspective type which is fragmentary only with respect to a portion of two metal parts of some unidentified machine which are to be clamped together, but which completely shows the clamp holding them together. In this view, the clamp is shown closed, clamping and fully locked relationship. A portion of a human hand gripping the clamp handle is shown in broken lines.

Figure 4:
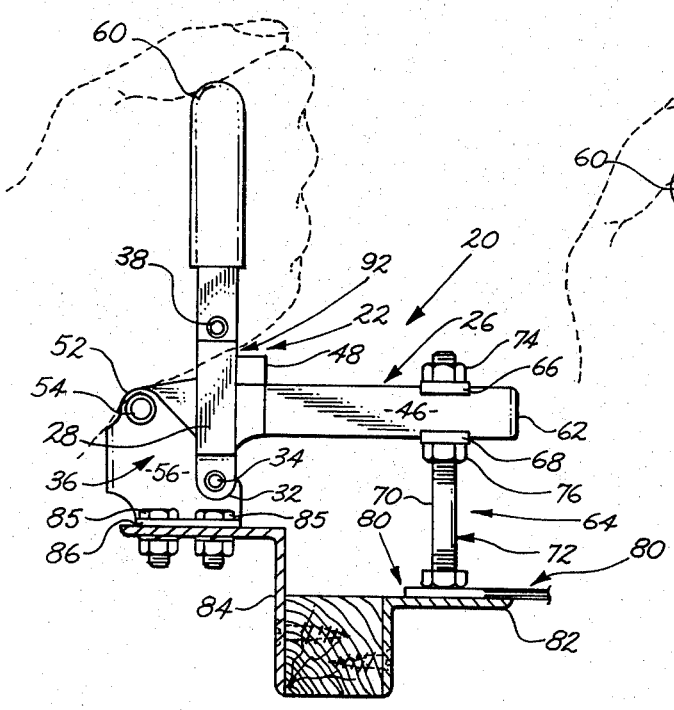
FIG. 4 is an enlarged and partially fragmentary elevational view of the clamp as seen from the said side as FIG. 1, but in this case, with the clamp having the edge-of-hand protective shield removed, so as to show how the little finger edge of the hand tends to take a lower position when the handle is grasped with the clamp in fully-closed position for the purpose of forcibly opening the clamp.
Figure 5:
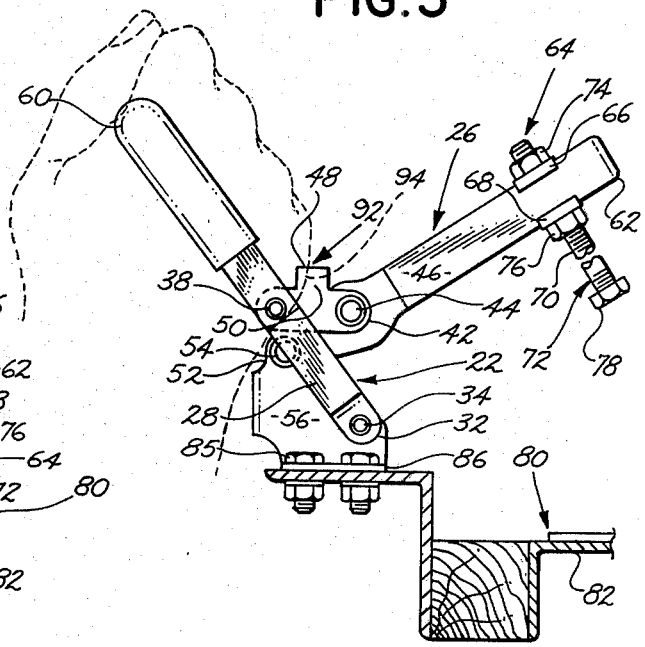

FIG. 5 is another fragmentary view similar to FIG. 4, but in this case, showing the clamp in partially open relationship and beginning to pinch the unprotected little finger edge of the human hand grasping the handle and forcibly opening the clamp. In other words, this view shows the undesirable results of operating a clamp which does not have the protective shield of the present invention in place.

Figure 6:
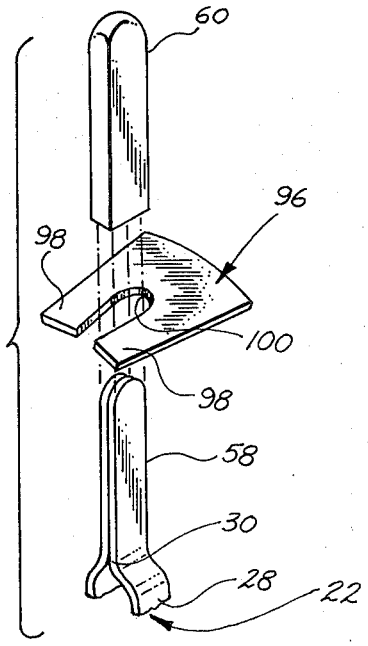

FIG. 6 is a view illustrating one mode of assembly or mounting of the novel edge-of-hand protective shield of the present invention on the pre-existing handle of the clamp and shows the clamp handle cover in exploded relationship to the upper end of the clamp handle and shows the apertured or slotted protective shield in exploded position above the upper end of the handle prior to slideably moving the handle cover downwardly onto the upper end of the clamp handle which will thus act to retain the protective shield in place at the proper location on the clamp handle.

Figure 3:
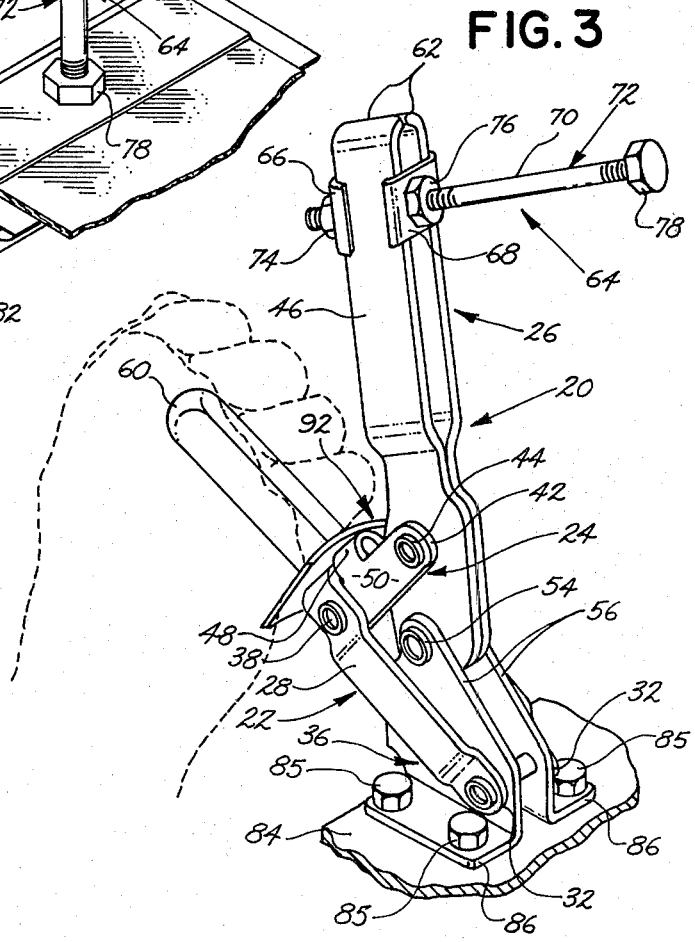
FIG. 3 is another perspective view like FIG. 2, but in this case, it shows the clamp in fully-open position and with the hand operating the clamp still being shown in broken-lines grasping the handle.
Figure 7:
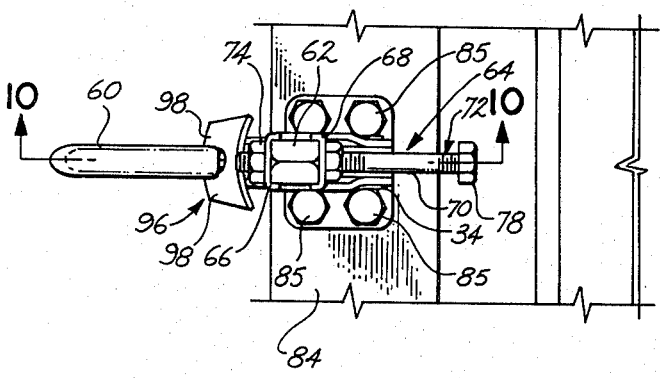

FIG. 7 is a top plan view of FIG. 3.

Figure 8:
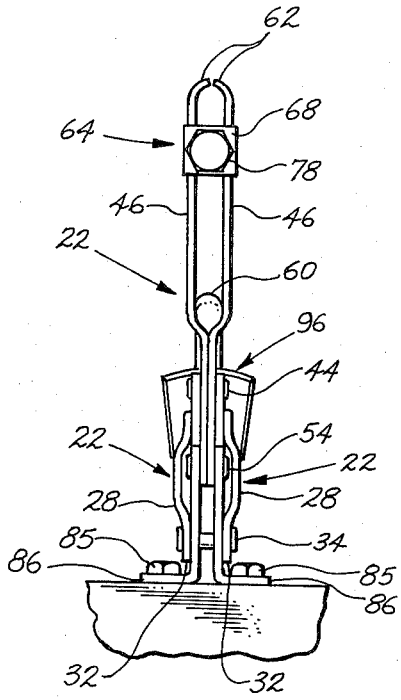

FIG. 8 is a right side elevational view of FIG. 3.

Figure 9:
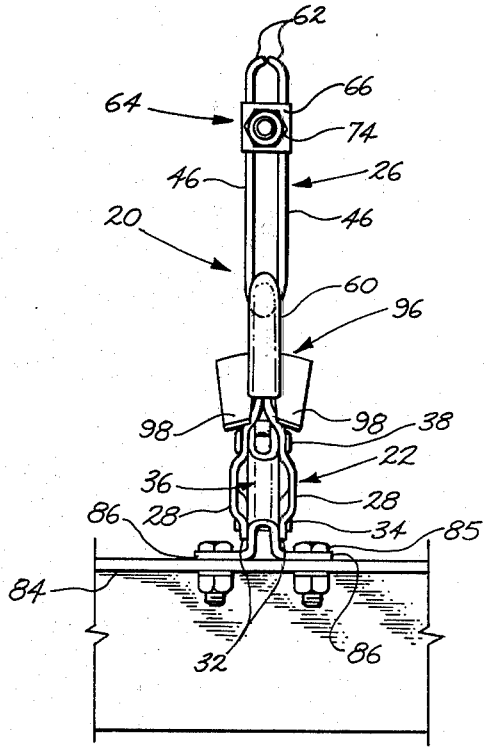

FIG. 9 is a left side elevational view of FIG. 3.

Figure 10:
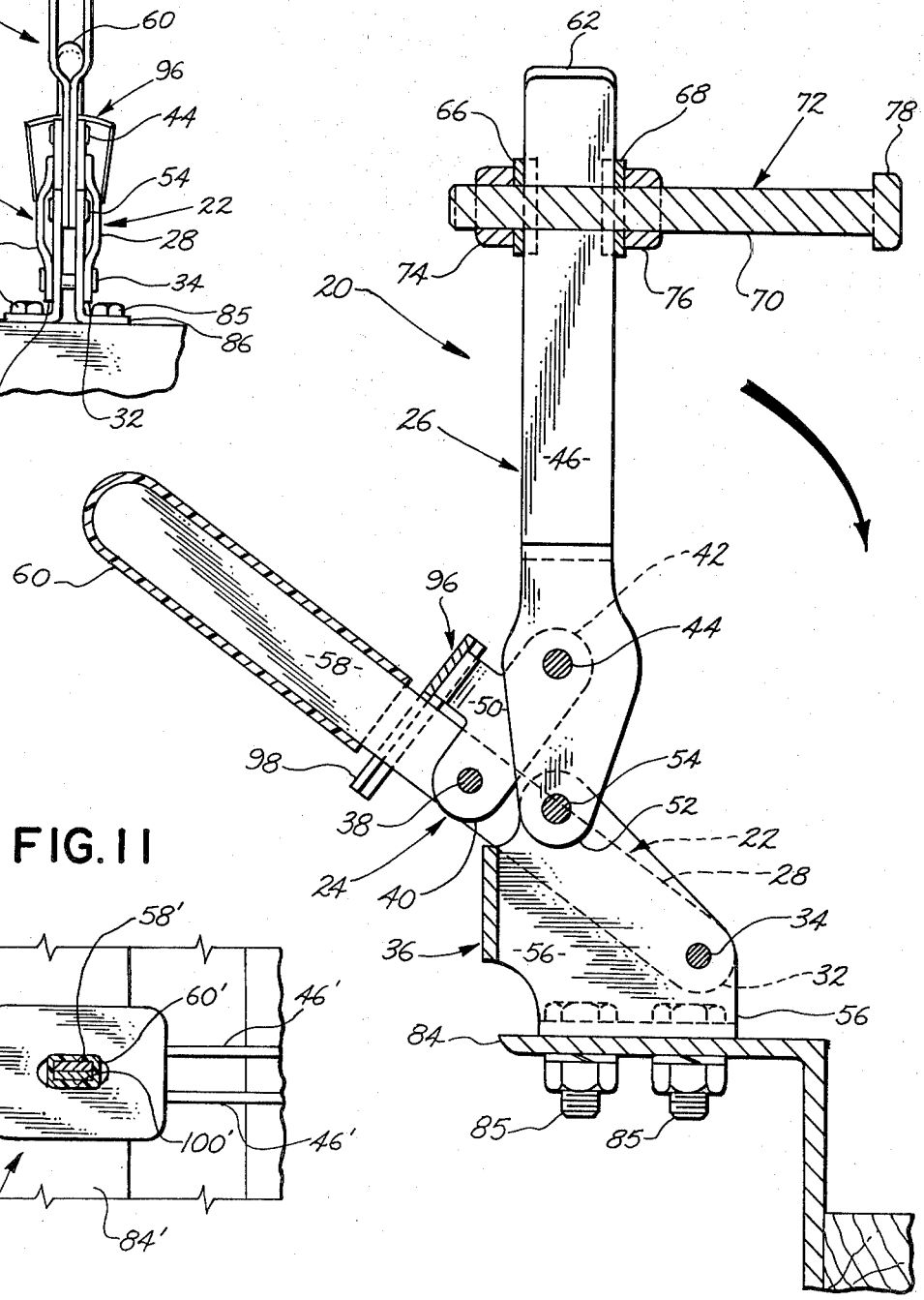

FIG. 10 is a central vertical plane sectional view taken substantially along the plane and in the direction indicated by the arrows 10—10 of FIG. 7.

Figure 1:
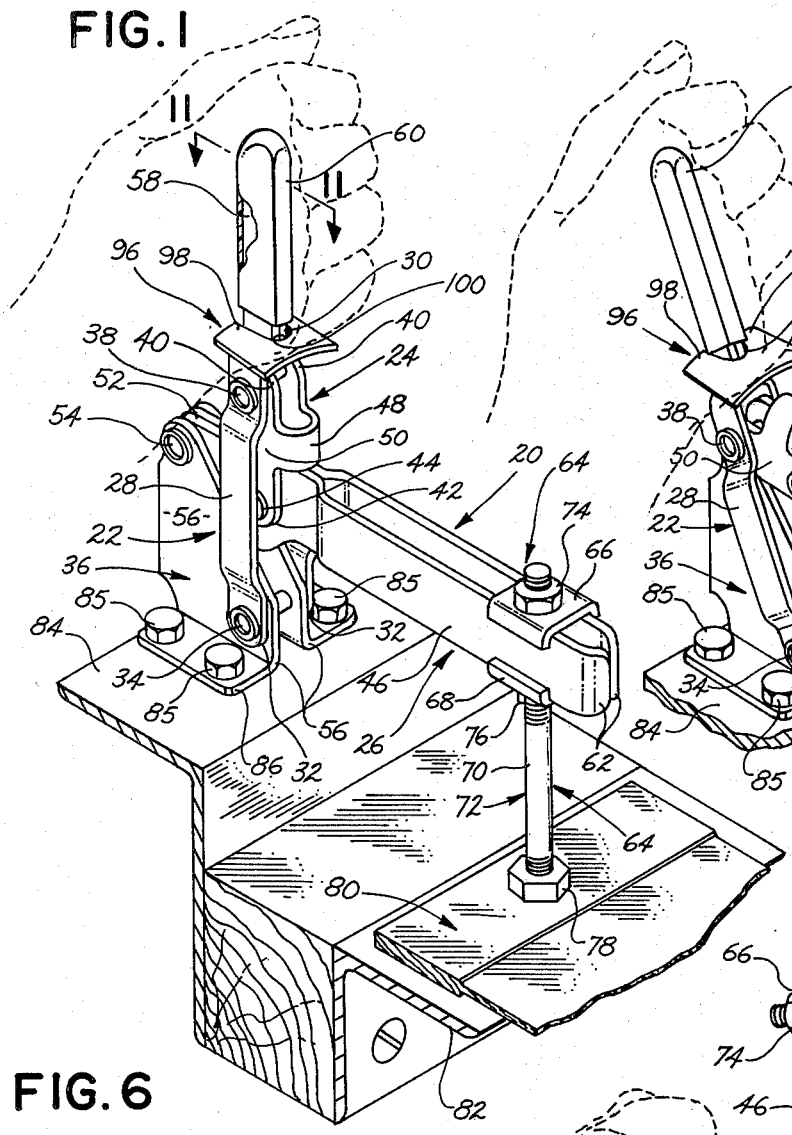
Figure 11:
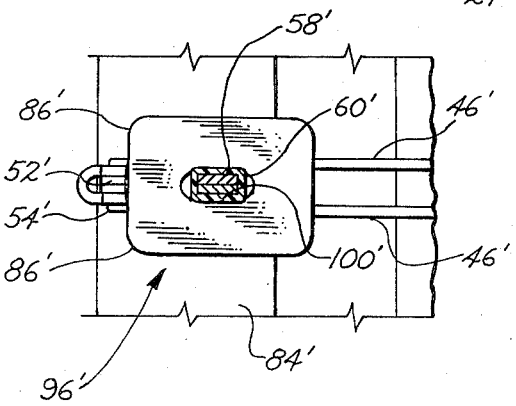

FIG. 11 is a fragmentary, sectional view of a slight modification of the shield as it would appear along the plane and in the direction of the arrows 11—11 of FIG. 1.

DESCRIPTION OF THE PREFERRED EMBODIMENTS

Generally speaking, the novel clamp hand protector of the present invention comprises both the novel edge-of-hand protective shield for mounting cooperation with a clamp of a type employing at least two (and usually three in one preferred form) linkage elements pivotally-interconnected and with one of same being coupled to an operating handle member for moving the pivotally-interconnected linkage elements, and the entire clamp, between closed clamped relationship and open unclamped relationship; the cooperation of the edge-of-hand protective shield being such as to completely protect the edge of an operator's hand from being pinched or injured during forced movement of the clamp member between closed and open position (or vice versa) by providing a complete isolator for the edge of an operator's hand relative to the arcuately-variable-angle region between any of the pivotally-interconnected linkage elements and, in particular, such a region position closely adjacent to an inner or lower end of such an operating handle member in one form of such a clamp. The invention also contemplates the combination of such a mounted clamp hand protector or edge-of-hand protective shield and such a clamp.

In the exemplary, but non-specifically limiting form of the invention illustrated, one such clamp is generally designated by the reference numeral 20 and is shown as comprising three pivotally-interconnected linkage elements, generally designated respectively at 22, 24 and 26.

In the example illustrated, the first linkage element 22 effectively comprises what might be termed a bifurcated yoke consisting of two similar transversely-spaced yoke members 28 which are formed inwardly into abutment with each other at the top thereof as indicated at 30 to effectively comprise an upper end of the first linkage element 22. The two transversely spaced yoke members 28 extend downwardly to transversely-spaced lower or inner terminal ends 32 which are pivotally-mounted by a transverse pivot pin 34 to a lower mounting part of a fixed bifurcated mounting base member 36. Similar upper portions of the two mounting yoke members 28 adjacent to the upper end 30 are provided with transverse pivot pin means 38 pivotally-interconnecting the upper end of said first linkage element 22 to the corresponding end 40 of the second linkage element 24, which is also of bifurcated construction having opposite transversely-spaced twin end portions 42 pivotally-connected by a third pivot pin 44 to an intermediate portion 46 of the third linkage element 26.

Said bifurcated second linkage element 24 has an upper loop portion 48 interconnecting the two transversely-spaced bifurcated arm portions 50 of said second linkage element 24 in order to provide structural strength and to act as a stop in a clamp-opening direction.

The third bifurcated element 26 has its inner end 52 pivotally-connected by a transverse pivot pin 54 between the two bifurcated plate members 56 of the base plate 36. The upper end of the first linkage element 22 is provided with a handle member which is shown at 58 and is indicated as being of spatulate cross-sectional configuration merely comprising upper extensions of the side-by-side adjacent yoke plate members 28 of the first linkage element 22, although not specifically so limited in all forms of the invention. In the example illustrated, the operating handle member 58 is also provided with a transversely-enlarged slipover handle member cover 60 which may be of any suitable elastomeric or compressible material appropriately functionable for facilitating the manual grasping thereof.

The outer end of the third linkage element 26 comprises a pair of bifurcated plates 62 adjustably carrying the actual clamp element, generally designated at 64, for adjustment anywhere along the length of the bifurcated plates 62 from the position adjacent to the pivot pin 44 to the extreme outer end of said plates 62 and also adjustable upwardly and downwardly whereby to facilitate any particular desired clamp position for one or more auxiliary work pieces which are intended to be clamped in position by the clamp 20.

In the example illustrated, the actual clamping element comprises a downwardly edge-curved upper sliding bracket member 66, a similar upwardly edge-curved lower sliding bracket member 68, each of which has aligned holes mounting the threaded shank 70 of abutment bolt 72, which threadedly engages upper and lower nuts 74 and 76. The arrangement is such that loosening either the upper nut 74 or the lower nut 76 will allow the entire clamping element 64 to be slidably moved inwardly or outwardly along the plates 62 until clamped into some desired position by tightening either the upper nut 74 or the lower nut 76. This adjusts the radial position of the abutment bolt 72 and the rest of the actual clamping element 64, and vertical adjustment of the abutment bolt 72 and in particular, of the lower abutment head 78 thereof is provided by threaded adjustment of the threaded shank 70 relative to the two upper and lower nuts 74 and 76. This is primarily for the purpose of adjusting the vertical position of the clamping bolt abutment head 78 when the entire clamp is in the locked clamping position, such as is shown in FIG. 1, suitable for fastening or clamping one auxiliary member, such as is shown in fragmentary form at 80, relative to a fixed underlying member, such as is shown at 82 is fragmentary form.

The clamp itself is adapted to be fixedly attached to any appropriately located fixed member, such as is shown at 84 in fragmentary form, and which is either fixed with respect to the other underlying fixed supporting member 82 by being effectively interconnected therewith by way of intervening structure (not shown), or by reason of the fact that each member 84 and 82 is firmly attached to, or supported by other members which are fixed with respect to any selected common horizontal reference plane or coordinate system.

In the example shown, the attachment of the clamp 20 to the auxiliary supporting member 84 is shown as being accomplished by the use of a plurality of mechanical fasteners 85 (bolts and nuts in the example shown) fastening bottom edge flanges 86 carried by the base plates 36 to the underlying fixed auxiliary supporting member 84 by way of corresponding bolt holes.

Figure 2:
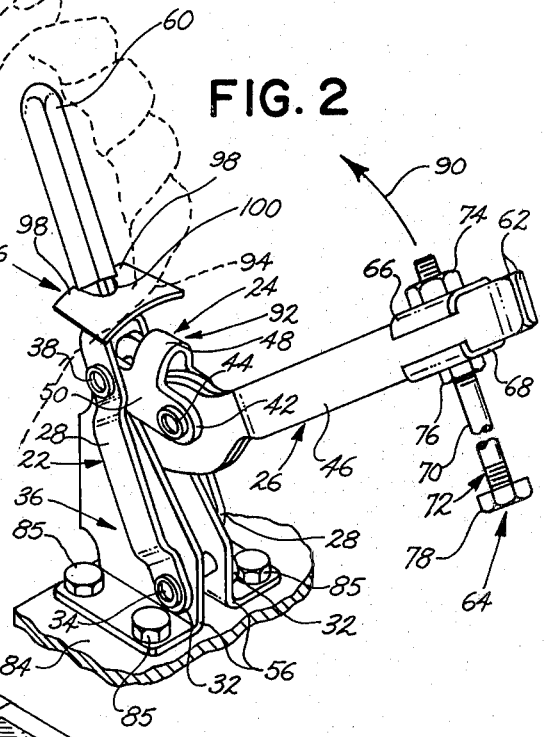
FIG. 2 is another perspective view seen from the same viewing point as FIG. 1, and in this case, the clamp is shown in an intermediate or approximately half-way open position with the broken-line hand still grasping the handle.

The operation of the clamp is believed to be apparent from a careful examination of FIGS. 1, 2, and 3. In FIG. 1, the clamp is shown in fully-closed, locked and clamped relationship holding the workpiece 80 firmly clamped onto the underlying fixed member 82 and with the three pivot pins 38, 44 and 34 vertically aligned and substantially offset in the clamping direction of movement of the handle 58 from the other pivot pin 54. In other words, both the handle 58 and the three above-mentioned pivot pins 38, 44 and 34 are "over-center" relative to the other pivot pin 54, which is what brings about the effectively locked relationship of the clamp 20.

When a human hand, such as that shown in broken lines at 88, grasps the handle 58 and forces it in the unclamping direction indication by the arrow 90, the first and second linkage elements 22 and 24 begin to move in a direction corresponding to the directional arrow 90 into a partially-open position such as that shown in FIG. 2, where it will be noted that the first linkage element 22 has pivoted relative to pivot pins 34 and 38, that the second linkage element 24 has pivoted relative to the pivot pins 38 and 44, and that the third linkage element 26 has pivoted relative to the pivot pin 54 and relative to the pivot pin 44, all of which bring about an upward pivotal unclamping movement of the third linkage element 26 and the abutment bolt 72 so that the abutment bolt head 78 has been moved out of clamping engagement relative to the auxiliary workpiece 80, which is now free for movement in any desired manner.

FIG. 3 merely illustrates the next stage in the forcible unclamping movement of both the handle 58, and the entire clamping structure 20 and in particular, the abutment bolt 72 and abutment head 78 thereof into fully-open position.

It should be clearly noted that the first and second pivotally-interconnected linkage elements 22 (including the attached handle 58) and 24 define what may be termed an arcuately-variable-angle junction region, indicated generally at 92, between the first and second linkage elements and that said region 92 defines a relatively large angle (actually approaching 180 degrees) when the clamp is in fully-clamped position, which junction angle 92 becomes progressively smaller as the handle 58 and the entire clamp 20 move into the partially-open position shown in FIG. 2 and that said junction angle 92 becomes even smaller (approaching 90 degrees) when the handle 58 and the entire clamp 20 are moved into the fully-open position shown in FIG. 3. This decreasing junction angle 92 could pinch or otherwise injure the little finger edge 94 of the operating hand 88 in the manner illustrated in FIGS. 4 and 5 except for the provision of the novel protective edge-of-hand shield indicated generally at 96 in FIGS. 1–3, wherein the shield 96 positively prevents the little finger edge 94 of the operating hand 88 from entering the dangerous arcuately-variable-angle junction region 92 and, thus, positively prevents any such hand-pinching or hand-injury from occurring, no matter how rapidly the clamp is opened.

On the other hand, if one considers FIGS. 4 and 5, without the protective shield 96 in place, it is clear that the little finger edge 94 of the operating hand 88 frequently tends to take a lower position relative to the handle 58 such that the little finger edge 94 does extend into said dangerous arcuately-variable-angle junction region 92 and will tend to be pinched and possibly even seriously injured when the clamp is forcibly and rapidly opened. The pinching and injury will tend to begin when the unprotected clamp is in a partially-open position such as is shown in FIG. 5 and is still being forcibly moved toward fully-open position.

It should be noted that in the exemplary form illustrated, the protective shield 96 takes the form of a small piece of thin sheet material 98 shaped for convenient covering isolation of the arcuately-variable-angle junction region 92 between the first and second pivotally-interconnected linkage elements 22 and 24 and for receiving, retaining and stopping cooperation with the little finger edge 94 of an operating hand 88 during the manual grasping of the handle member 58 (and its cover 60) for forcible operation of the clamp 20. This is true for operation of the clamp in either direction, but is primarily important during operation of the clamp 20 in an unlocking and unclamping direction of movement, such as is indicated by the directional arrow 90.

In the example illustrated, the protective shield 96 may be substantially flat or slightly curved, or otherwise suitably shaped for the isolation and edge-of-hand receiving purposes mentioned above.

The protective shield 96 may be initially provided as part of the complete clamp, or may be mounted on a pre-existing clamp in order to provide the hand protection cooperation therewith described in detail hereinbefore. While any suitable mounting arrangement and structure may be employed for mounting the protective shield 96 at the proper shielding location described hereinbefore, and clearly shown in FIGS. 1–3, one exemplary, but non-specifically limiting, mounting structure and arrangement is shown as comprising outwardly converging slotted aperture means, or aperture-defining means 100 arranged for cooperation with the handle member 58 when it is of the spatulate cross-sectionally-shaped configuration illustrated. This arrangement allows the converging slotted aperture means 100 to be slidably moved downwardly onto and along the spatulate handle member 58 whenever the transversely-enlarged slipover handle member cover 60 is not mounted on the handle member 58. This might be during initial assembly of the clamp and before the mounting of the slipover handle member cover 60 occurs, or, in the case of a pre-existing clamp, the cover 60 can be removed and the slotted aperture means 100 can be slidably mounted on the handle member 58, after which, the cover 60 can be remounted on the handle member 58.

Alternatively, the slotted aperture means 100 may initially be of a non-converging configuration so as to be capable of being directly laterally slidably moved onto the lower portion of the handle member 58 at the desired protective location, after which, the portions of the protective shield thin sheet member 98 lying on each side of the opened end of the slotted aperture 100 may be forcibly displaced slightly toward each other, so as to cause them to effectively provide a converging outer end for the slotted aperture means 100. This will retain the protective shield 96 in place.

The above-mentioned shield mounting structure and the several different modes of mounting same are exemplary only of a variety of different functionally equivalent structures and corresponding equivalent mounting procedures which bring about substantially the same end result, and all of which are included herein. The protective cover 60 may be of cellular plastic foam, rubber, or various other suitable elastomeric or compressible materials and is preferably slidably mounted on the handle 58, although it may be adhesively or otherwise affixed thereto if desired.

While the present invention has been defined in the foregoing description with reference to one illustrative particular type of clamp, it is not intended to be specifically limited to that particular clamp only, but to any clamp having such an arcuately-variable-angle region which may injure any portion of an operating hand, which injury can be prevented by the appropriate mounting of the novel edge-of-hand protective shield of the present invention to provide a positive clamp hand protector lying within the broad scope of the present invention.

It should be understood that the protective shield 96 illustrated in the first form of the invention is exemplary only and is not to be construed as specifically limiting the invention to the particular shape, size or mounting structure shown therein and described in detail hereinbefore. It should be clear that the present invention includes the broad concept of such a shield in the edge-of-hand protective position, irrespective of the exact structure, size, shape and mounting structure employed for mounting it on the operating handle 58. One such exemplary, but non-specifically limiting, slightly modified protective shield is shown in plan view in FIG. 11 where all parts illustrated corresponding to the first form of the invention are designated by similar reference numerals, primed, however. As shown in FIG. 11, the protective shield 96' effectively comprises an elongated closed washer-like structure which does not have a slotted aperture means or aperture-defining means open at the end such as that best shown at 100 in FIG. 6 illustrating the first exemplary form of the invention.

As shown in FIG. 11, the handle-receiving hole or aperture 100' is not a side opening slot which, of course, requires that it be mounted by moving it slideably downwardly on the handle 58' before the cover 60' is mounted on the upper end of the handle 58'. In the protective shield modification illustrated in FIG. 11, the aperture 100' is of a laterally elongated configuration so as to very closely fit the handle 58', rather than being a circular aperture. However, in certain further modifications, it could be of substantially circular shape (or any other appropriate capable-of-being-mounted shape) and this is also true of the plan view configuration of the entire washer-like edge-of-hand protective shield 96'. It might be of other than the elongated shape shown in FIG. 11 and could be circular or otherwise shaped in any manner capable of providing the desired edge-of-hand protective function without otherwise interfering with the operation of the entire clamp, and all such modifications are intended to be included within the broad scope of the present invention.

It should be understood that the figures and the specific description thereof set forth in this application are for the purpose of illustrating the present invention and are not to be construed as limiting the present invention to the precise and detailed specific structures shown in the drawing figures and specifically described hereinbefore. Rather, the real invention is intended to inclue substantially equivalent construction embodying the basic teachings and inventive concept of the present invention.

What is claimed is:

1. In a clamp hand protector for use on a toggle-type pivotally interconnected three-linkage-elements clamp, wherein a first clamp linkage element is provided with an outwardly extending spatulate operating handle member having a second linkage element pivotally connected thereto adjacent to a junction between a lower end of said operating handle member and an upper end of said first clamp linkage element, the provision of: a pusher-type, toggle-form, positively locking and unlocking by an overcenter movement and the reverse thereof,pivotally interconnected three-linkage-elements clamp, including a longitudinal first clamp linkage element provided at an inner bottom end thereof with, and being transversely pivotally attached to, a fixedly mounted base member, which in turn is provided with first pivotal mounting means comprising first pivot pin means pivotally interconnecting said inner bottom end of said first linkage element with said fixedly attached base member for rotation around a first pivot pin axis transverse to the longitudinal direction of said first linkage element, with said longitudinal first linkage element having an outer junction portion at the outer uper end thereof provided with and rigidly joined to a longitudinally aligned, outwardly extending, spatulate operating handle member, and further including a longitudinal second clamp linkage element having a rear and upper-when-locked end provided with second pivotal mounting means comprising second pivot pin means pivotally interconnecting said rear and upper-when-locked end of said second linkage element with said outer and upper junction portion at the outer upper end of said longitudinal first clamp linkage element at a location higher than and spaced above said first pivot pin means when said first and second linkage elements are forcibly manually moved forwardly into clamp-locked relationship by correspondingly forcibly manually moving said operating handle forwardly, and further including a longitudinal third clamp linkage element having a rear-when-locked end provided with third pivotal mounting means comprising third pivot pin means pivotally interconnecting said rear-when-locked end of said third clamp linkage element with said fixedly mounted base member at a location upwardly, outwardly and rearwardly displaced from the location of said first pivot pin means, with said longitudinal second linkage element having a forward and lower-when-locked opposite end provided with a fourth pivotal mounting means comprising a fourth pivot pin means pivotally interconnecting said forward and lower-when-locked opposite end of said second linkage element with said third linkage element at an intermediate location spaced directly forwardly of said third pivot pin means when said first, second and third clamp linkage elements are in clamp-locked relationship; an edge-of-hand protective shield provided with mounting means cooperable with the composite effectively joined first clamp linkage element and operating handle member coupled thereto adjacent to an intermediate junction or coupling region therebetween at a location adjacent to said junction portion and effectively separating shielding and isolating said handle member from a second linkage element pivotally connected to said first linkage element adjacent to the inner end of said handle member for effectively preventing the movement of an operating human hand grasping the handle member into an arcuately-variable-angle junction region between the first and second pivotally interconnected linkage elements.

2. A clamp hand protector as defined in claim 1, wherein the mounting means of said protective shield comprises outwardly converging slotted aperture means for cooperation with the spatulate cross-sectionally-shaped configuration of the handle member, whereby to be downwardly slidable thereonto into stopping abutment with an upper end of the first linkage element, which is provided with a bifurcated clevis-mounting yoke for pivotal connection thereof to a corresponding end of the second interconnecting linkage element.

3. A clamp hand protector as defined in claim 1, wherein the mounting means of said protective shield comprises outwardly converging slotted aperture means for cooperation with the spatulate cross-sectionally-shaped configuration of the handle member, whereby to be downwardly slidable thereonto into stopping abutment with an upper end of the first linkage element, which is provided with a bifurcated clevis-mounting yoke for pivotal connection thereof to a corresponding end of the second interconnecting linkage element and retainedly cooperable with a transversely-enlarged slipover handle member cover adapted to be mounted on the handle member after mounting of the protective shield immediately therebelow.

4. A clamp hand protector as defined in claim 1, wherein said protective shield is of thin sheet material curvedly-shaped for convenient covering isolation of said arcuately-variable-angle junction region betwen the first and second pivotally interconnected linkage elements and for receiving, retaining, and stopping cooperation with the little finger edge of a hand during the manual grasping of the handle member by such a hand for forcibly operating the clamp.

5. A clamp hand protector as defined in claim 2, wherein said protective shield is of thin sheet material curvedly-shaped for convenient covering isolation of said arcuately-variable-angle junction region between the first and second pivotally interconnected linkage elements and for receiving, retaining, and stopping co-operation with the little finger edge of a hand during the manual grasping of the hand member by such a hand for forcibly operating the clamp.

6. A clamp hand protector as defined in claim 3, wherein said protective shield is of thin sheet material curvedly-shaped for convenient covering isolation of said arcuately-variable-angle junction region between the first and second pivotally interconnected linkage elements and for receiving, retaining, and stopping co-operation with the little finger edge of a hand during the manual grasping of the handle member by such a hand for forcibly operating the clamp.

* * * * *